US010082291B2

(12) United States Patent
Gao et al.

(10) Patent No.: US 10,082,291 B2
(45) Date of Patent: Sep. 25, 2018

(54) COMBUSTION SUPPORTING DEVICE

(71) Applicant: National Chung-Shan Institute of Science and Technology, Taoyuan County (TW)

(72) Inventors: Chung-Hsing Gao, Taoyuan County (TW); Hsun-Ming Hsien, Taoyuan County (TW); Zong-Yi Weng, Taoyuan County (TW); Yann-Long Kuo, Taoyuan County (TW)

(73) Assignee: NATIONAL CHUNG-SHAN INSTITUTE OF SCIENCE AND TECHNOLOGY, Taoyuan County (TW)

( * ) Notice: Subject to any disclaimer, the term of this patent is extended or adjusted under 35 U.S.C. 154(b) by 431 days.

(21) Appl. No.: 14/971,280

(22) Filed: Dec. 16, 2015

(65) Prior Publication Data

US 2016/0209030 A1 Jul. 21, 2016

(30) Foreign Application Priority Data

Jan. 16, 2015 (TW) ..... 104101531 A

(51) Int. Cl.
*F23L 1/00* (2006.01)
*F23L 9/00* (2006.01)
*F23B 60/00* (2006.01)

(52) U.S. Cl.
CPC ..... *F23L 9/00* (2013.01); *F23B 60/00* (2013.01); *F23L 1/00* (2013.01)

(58) Field of Classification Search
CPC ..... F23L 1/02; F23C 10/20
See application file for complete search history.

(56) References Cited

U.S. PATENT DOCUMENTS 421,744 A * 2/1890 Miller ..... F23L 1/00 110/118
1,536,220 A * 5/1925 Jouclard ..... F23G 5/24 110/251
1,866,959 A * 7/1932 Wyse ..... F23G 5/12 110/252

(Continued)

FOREIGN PATENT DOCUMENTS

CH 234553 A * 10/1944 ..... F23L 1/02

*Primary Examiner* — David J Laux
(74) *Attorney, Agent, or Firm* — Chun-Ming Shih

(57) ABSTRACT

A combustion supporting device is provided to use with a combustion furnace. The combustion supporting device includes a cone body, a tubular member, a frusto-conically shaped member, a base plate and a supporting portion. An upper end of the tubular member is connected to the cone body. The tubular member defines a plurality of gas holes around an upper portion thereof. The frusto-conically shaped member defines an insertion opening thereon. The diameter of the insertion opening corresponds to the outer diameter of the tubular member. A lower portion of the tubular member is passing through the insertion opening and received in the frusto-conically shaped member. The base plate defines a hole corresponding to the tubular member. The base plate is connected to a bottom of the frusto-conically shaped member. The hole communicates with a lower opening of the tubular member. The supporting portion is connected to the base plate.

11 Claims, 4 Drawing Sheets

(56) References Cited

U.S. PATENT DOCUMENTS

| | | | | | |
|---|---|---|---|---|---|
| 2,232,556 | A * | 2/1941 | Nichols | F23G 5/28 | 110/247 |
| 2,715,881 | A * | 8/1955 | O'Neil | F23G 5/00 | 110/251 |
| 2,826,039 | A * | 3/1958 | Ashwood | F23R 3/04 | 60/743 |
| 4,841,884 | A * | 6/1989 | Engstrom | B01J 8/44 | 110/245 |
| 5,799,590 | A * | 9/1998 | Noguchi | F23G 5/245 | 110/165 R |
| 2012/0214109 | A1* | 8/2012 | Begina | F23C 10/20 | 431/170 |

* cited by examiner

COMBUSTION SUPPORTING DEVICE

BACKGROUND OF THE INVENTION

Field of the Invention

The present invention relates to a combustion supporting device, in particular, to a combustion supporting device provided to maintain the temperature inside a combustion furnace and to allow the combustion furnace to achieve better combustion efficiency.

The Prior Arts

Combustion furnaces burn combustible materials, such as woods, leaves, papers, charcoals or other biomass fuels therein, so that the combustion furnace can be used to cook or to generate heat. Conventionally, a combustion furnace includes an inner shell and an outer shell. The inner shell is provided as the space for the combustion. Combustion furnaces are also used as heat providers for families. In addition to large sized combustion furnaces used in households or industries, combustion furnaces are also suitable for outdoor activities, and the volume and weight of combustion furnaces have gradually been reduced to allow for personal combustion furnaces.

Additionally, the combustion efficiency of the combustion furnace depends on whether the gas inside the combustion furnace flows fluently to maintain the temperature inside the combustion furnace. Conventionally, due to the heat convection of the combustion furnace being insufficient, the temperature inside the combustion furnace is insufficient, resulting in incomplete combustion. Consequently, combustion in the conventional combustion furnace takes more time, and the user needs to add fuel to the combustion furnace continuously, to maintain the internal temperature.

SUMMARY OF THE INVENTION

Consequently, how to maintain the temperature inside the combustion furnace and how to improve the performance of the combustion furnace, are issues to be addressed by the applicants and related personnel.

To address this issue, the present invention provides a combustion supporting device to be used with a combustion furnace. The combustion supporting device comprises a cone body, a tubular member, a frusto-conically shaped member, a base plate and a supporting portion. An upper end of the tubular member is connected to the cone body. The tubular member defines a plurality of gas holes around an upper portion thereof. The frusto-conically shaped member defines an insertion opening thereon. The diameter of the insertion opening corresponds to the outer diameter of the tubular member. A lower portion of the tubular member is passing through the insertion opening and received in the frusto-conically shaped member. The base plate defines a hole corresponding to the tubular member. The base plate is connected to a bottom of the frusto-conically shaped member. The hole communicates with a lower opening of the tubular member. The supporting portion is connected to the base plate.

In some implementation aspects, the combustion supporting device is made of heat-resistant steel or ceramic composite material.

In some implementation aspects, the range of the outer diameter of the tubular member is defined from 1 cm to 30 cm.

In some implementation aspects, the range of the diameter of each of the gas holes is defined from 0.3 cm to 5 cm.

In some implementation aspects, the supporting portion of the combustion supporting device is a plurality of supporting rods connected to the base plate.

In some implementation aspects, the base plate further comprises a plurality of positioning holes. The number of the positioning holes corresponds to the number of the supporting rods. Each of the supporting rods comprises a connecting member and a stand. One of two ends of each of the stands is passing through the corresponding positioning hole and connected to the connecting member, and the other end of each of the stands is exposed from a bottom plane of the base plate.

In some implementation aspects, the outer surface of the lower portion of the tubular member and an inner wall of the frusto-conically shaped member define a filling space therein.

In some implementation aspects, the combustion supporting device further comprises at least one heat-resistant material placed in the filling space.

In some implementation aspects, the heat-resistant material is powdered.

In some implementation aspects, the heat-resistant material is a ceramic material.

Based on the above, the combustion supporting device may be a mechanical structure and mated with a combustion furnace. The tubular member and the cone body are assembled with each other to define a space in which gas can freely flow in the space. The gas holes defined around the upper portion of the tubular member allows the combustion supporting device to maintain the temperature inside the combustion furnace, so that the complete combustion can be achieved and black smoke and dust can be reduced.

Detailed description of the characteristics and the advantages of the present invention is shown in the following embodiments, the technical content and the implementation of the present invention should be readily apparent to any person skilled in the art from the detailed description, and the purposes and the advantages of the present invention should be readily understood by any person skilled in the art with reference to content, claims and drawings in the present invention.

BRIEF DESCRIPTION OF THE DRAWINGS

The present invention will become more fully understood from the detailed description given herein below for illustration only, and thus not limitative of the present invention, wherein.

DETAILED DESCRIPTION OF THE PREFERRED EMBODIMENT

Figure 1:
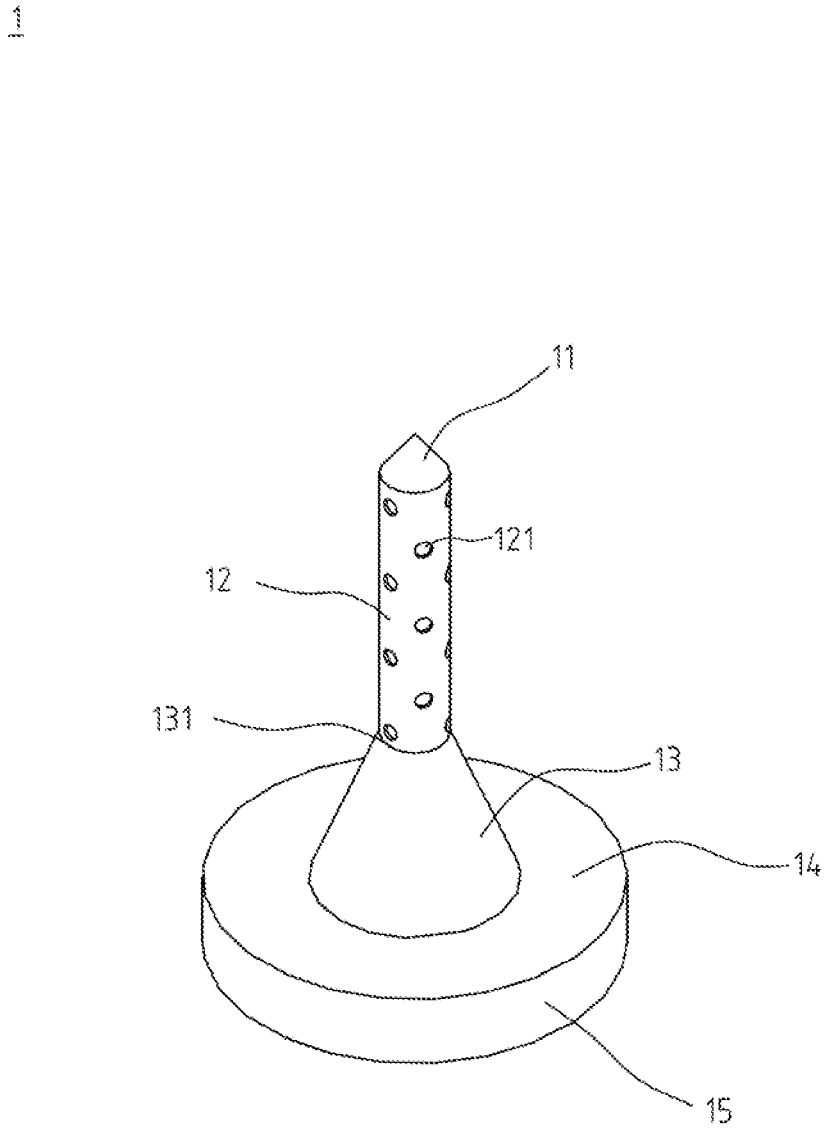
FIG. 1 is a perspective view of a first embodiment of a combustion supporting device according to the present invention.
Figure 4:
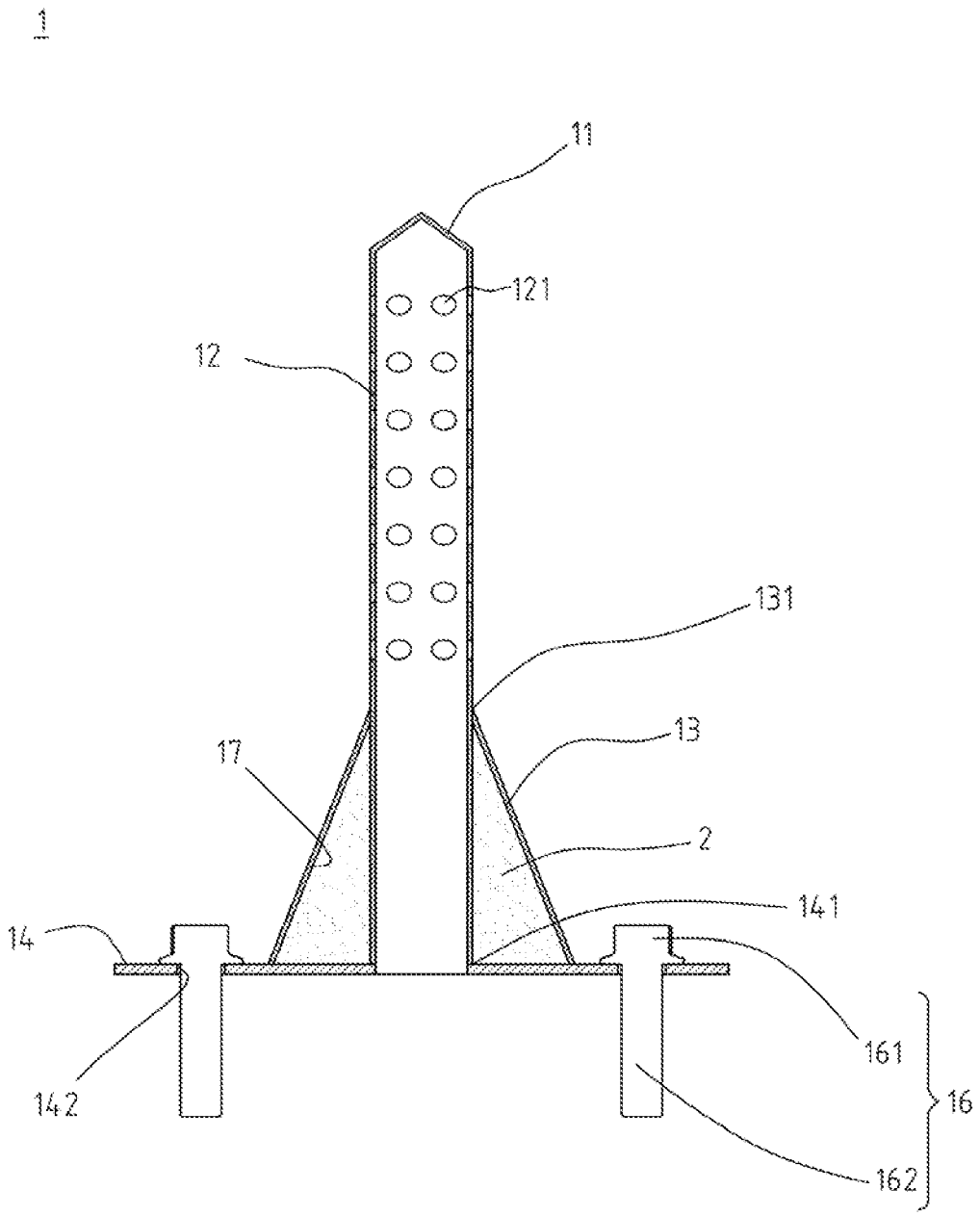
FIG. 4 is a sectional view of a fourth embodiment of a combustion supporting device according to the present invention.

Please refer to FIG. 1, illustrating a perspective view of a first embodiment of a combustion supporting device 1 according to the present invention. The combustion supporting device 1 is to be used with a combustion furnace and comprises a cone body 11, a tubular member 12, a frusto-conically shaped member 13, a base plate 14 and a supporting portion 15. An upper end of the tubular member 12 is connected to the cone body 11. The tubular member 12 defines a plurality of gas holes 121 around an upper portion thereof. The frusto-conically shaped member 13 defines an insertion opening 131 thereon. The diameter of the insertion opening 131 corresponds to the outer diameter of the tubular member 12. A lower portion of the tubular member 12 is passing through the insertion opening 131 and received in the frusto-conically shaped member 13. The base plate 14 defines a hole 141 thereon (as shown in FIG. 4), and the hole 141 corresponds to the tubular member 12. The base plate 14 is connected to a bottom of the frusto-conically shaped member 13. The hole 141 communicates with a lower opening of the tubular member 12. The supporting portion 15 is connected to the base plate 14.

In some implementation aspects, the combustion supporting device 1 is made of heat-resistant steel or ceramic composite material.

In some implementation aspects, the range of the outer diameter of the tubular member 12 is defined from 1 cm to 30 cm. Preferably, the range of the outer diameter of the tubular member 12 is defined from 2 cm to 10 cm.

In some implementation aspects, the range of the diameter of each of the gas holes 121 is defined from 0.3 cm to 5 cm. Preferably, the range of the diameter of each of the gas holes 121 is defined from 0.5 cm to 1.5 cm.

Figure 2:
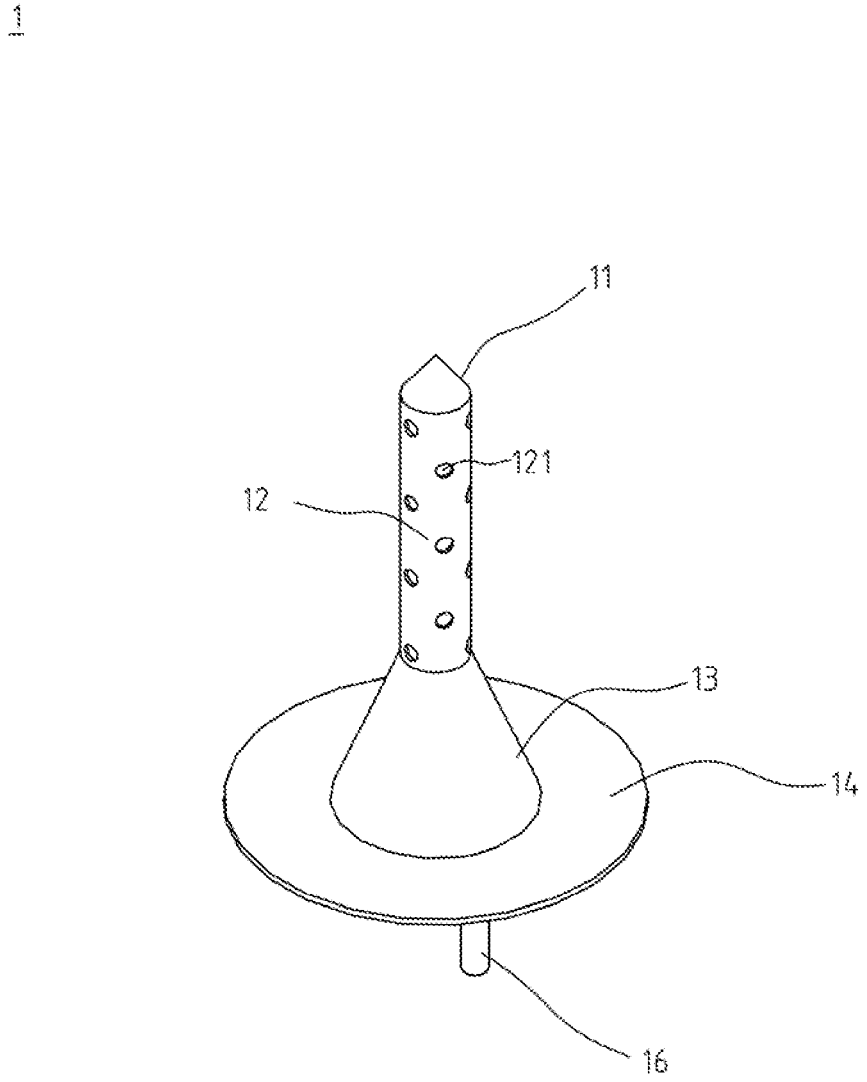
FIG. 2 is a perspective view of a second embodiment of a combustion supporting device according to the present invention.

Please refer to FIG. 2, illustrating a perspective view of a second embodiment of a combustion supporting device 1 according to the present invention. In this embodiment, the supporting portion 15 of the combustion supporting device 1 is a plurality of supporting rods 16 connected to the base plate 14. For example, the supporting rods 16 are connected to the base plate 14 by welding techniques.

Figure 3:
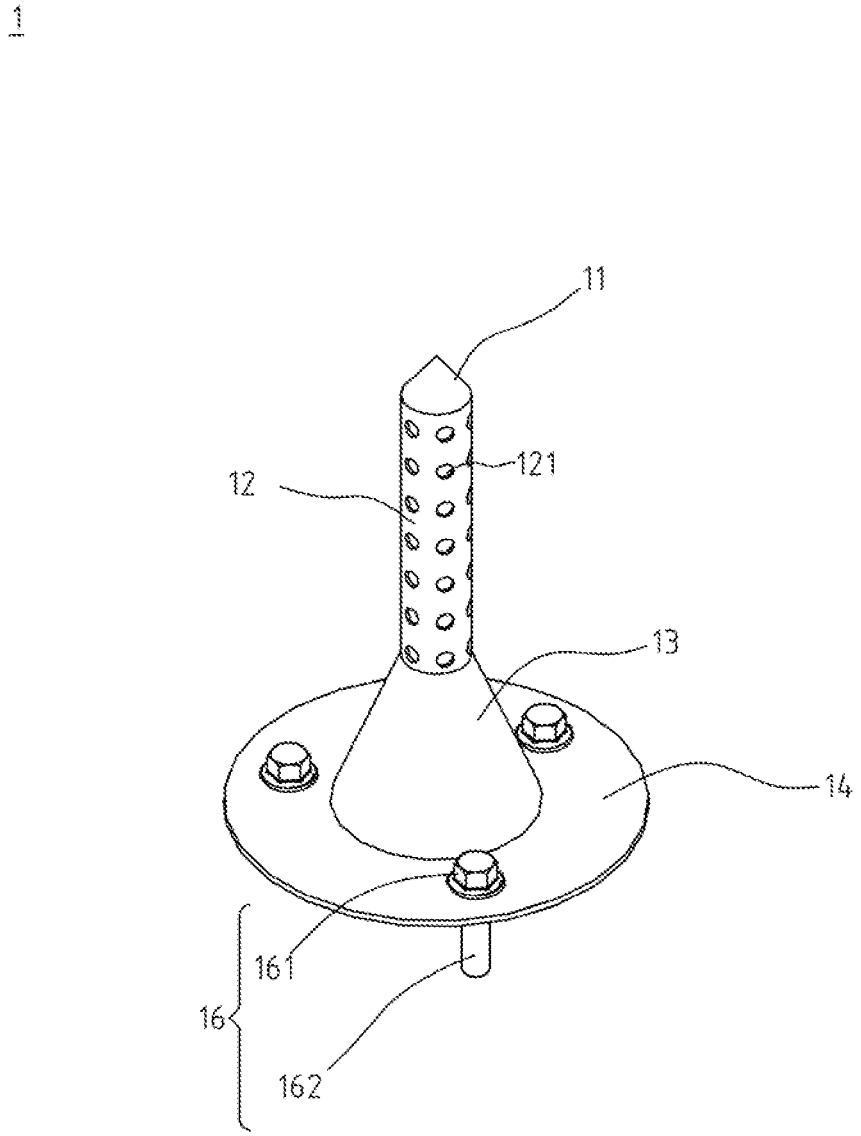
FIG. 3 is a perspective view of a third embodiment of a combustion supporting device according to the present invention.

Please refer to FIG. 3, illustrating a perspective view of a third embodiment of a combustion supporting device 1 according to the present invention. In this embodiment, the base plate 14 further comprises a plurality of positioning holes 142 (as shown in FIG. 3 and FIG. 4). The number of the positioning holes 142 corresponds to the number of the supporting rods 16. Each of the supporting rods 16 comprises a connecting member 161 and a stand 162. One of two ends of each of the stands 162 is passing through the corresponding positioning hole 142 and connected to the connecting member 161, and the other end of each of the stands 162 is exposed from a bottom plane of the base plate 14. As shown in FIG. 3, in this embodiment each of the connecting members 161 comprises a nut and a washer, and the stands 162 are screws, so that the screws are respectively threaded with the nuts and the washers, but embodiments are not limited thereto.

The combustion supporting device 1 is provided to be assembled to a bottom of an inner shell of the combustion furnace, and the supporting portion 15 (or the supporting rods 16) is securely or detachably connected to the inner shell of the combustion furnace. The height of the supporting portion 15 (or heights of the supporting rods 16), allows a vertical distance to be defined between the bottom of the frusto-conically shaped member 13 and the bottom of the inner shell. The vertical distance may be at the range from 0.3 cm to 20 cm. Preferably, the vertical distance is at the range from 1 cm to 5 cm.

Accordingly, the combustion supporting device 1 according to the present invention is provided to assemble in the combustion furnace. The supporting portion 15 (or the supporting rods 16), is then connected with the inner shell of the combustion furnace so as to fix the combustion supporting device 1 with the inner shell. The inner shell defines a through hole at a bottom thereof, and the combustion supporting device 1 is assembled above the through hole. The vertical distance between the bottom of the frusto-conically shaped member 13 and the bottom of the inner shell of the combustion furnace allows parts of rotating air flows to be guided into the interior of the inner shell from the hole at the base plate, so that the gases are passing through the combustion supporting device 1 to induce a rotating combustion field for facilitating the combustion inside the combustion furnace.

Please refer to FIG. 4, illustrating a sectional view of a fourth embodiment of a combustion supporting device 1 according to the present invention. As shown, the outer surface of the lower portion of the tubular member 12 and an inner wall of the frusto-conically shaped member 13 define a filling space 17 therein, and the combustion supporting device 1 further comprises at least one heat-resistant material 2 placed in the filling space 17. The heat-resistant material 2 is powdered and is a ceramic material. The heat-resistant material 2 can be made of, but not limited to, zirconium oxide or aluminum oxide.

Based on the above, the combustion supporting device may be a mechanical structure and mated with a combustion furnace. The tubular member and the cone body are assembled with each other to define a space in which gas can freely flow in the space. The gas holes defined around the upper portion of the tubular member allows the combustion supporting device to maintain the temperature inside the combustion furnace. In addition, the rotating high-temperature flame generated by the combustion supporting device and the air flows within the interior of the combustion furnace would draw the incomplete burned smokes or dusts back to the combustion region of the combustion furnace. Accordingly, the complete combustion can be achieved and black smokes and dusts emitted from the combustion furnace can be reduced.

While the present invention has been described by the way of example and in terms of the preferred embodiments, it is to be understood that the invention need not be limited to the disclosed embodiments. On the contrary, it is intended to cover various modifications and similar arrangements included within the spirit and scope of the appended claims, the scope of which should be accorded the broadest interpretation so as to encompass all such modifications and similar structures.

What is claimed is:

1. A combustion supporting device, to be used with a combustion furnace, the combustion supporting device comprising:

a cone body;

a tubular member, an upper end of the tubular member connected to the cone body, the tubular member defining a plurality of gas holes around an upper portion thereof;

a frusto-conically shaped member, defining an insertion opening thereon, the diameter of the insertion opening corresponding to the outer diameter of the tubular member, a lower portion of the tubular member passing through the insertion opening and received in the frusto-conically shaped shaped member;

a base plate, defining a hole corresponding to the tubular member, the base plate is connected to a bottom of the frusto-conically shaped member, wherein the hole communicates with a lower opening of the tubular member; and a supporting portion, connected to the base plate.

2. The combustion supporting device according to claim 1, wherein the combustion supporting device is made of heat-resistant steel or ceramic composite material.

3. The combustion supporting device according to claim 1, wherein the range of the outer diameter of the tubular member is defined from 1 cm to 30 cm.

4. The combustion supporting device according to claim 1, wherein the range of the diameter of each of the gas holes is defined from 0.3 cm to 5 cm.

5. The combustion supporting device according to claim 1, wherein the supporting portion is a plurality of supporting rods connected to the base plate.

6. The combustion supporting device according to claim 5, wherein the base plate comprises a plurality of positioning holes, the number of the positioning holes corresponds to the number of the supporting rods, wherein each of the supporting rods comprises:

a connecting member; and a stand, one of two ends of the stand passing through the corresponding positioning hole and connected to the connecting member, and the other end of the stand is exposed from a bottom plane of the base plate.

7. The combustion supporting device according to claim 1, wherein the outer surface of the lower portion of the tubular member and an inner wall of the frusto-conically shaped member define a filling space therein.

8. The combustion supporting device according to claim 7, further comprising a heat-resistant material placed in the filling space.

9. The combustion supporting device according to claim 8, wherein the heat-resistant material is a ceramic material.

10. The combustion supporting device according to claim 8, wherein the heat-resistant material is powdered.

11. The combustion supporting device according to claim 9, wherein the heat-resistant material is powdered.

* * * * *